US007155861B2

(12) United States Patent
Berry et al.

(10) Patent No.: US 7,155,861 B2
(45) Date of Patent: Jan. 2, 2007

(54) SLIDING DOOR HAVING LATERAL KEEPER

(75) Inventors: Curtis L. Berry, Williamsport, MD (US); William B. Nichols, Chambersburg, PA (US)

(73) Assignee: Jamison Door Company, Hagerstown, MD (US)

( * ) Notice: Subject to any disclaimer, the term of this patent is extended or adjusted under 35 U.S.C. 154(b) by 42 days.

(21) Appl. No.: 10/912,860

(22) Filed: Aug. 6, 2004

(65) Prior Publication Data

US 2005/0005524 A1 Jan. 13, 2005

Related U.S. Application Data

(63) Continuation-in-part of application No. 10/600,101, filed on Jun. 20, 2003, now abandoned.

(51) Int. Cl.
*E05D 15/10* (2006.01)

(52) U.S. Cl. ..... 49/225; 49/209

(58) Field of Classification Search ..... 49/209, 49/211, 116, 118, 221, 225
See application file for complete search history.

(56) References Cited

U.S. PATENT DOCUMENTS 400,562 A * 4/1889 Goelet ..... 49/213
1,116,728 A * 11/1914 Posson ..... 49/225
1,209,733 A * 12/1916 Lester ..... 49/225
1,250,816 A * 12/1917 Dunderdale ..... 49/225
2,937,867 A * 5/1960 Schweig ..... 49/118
3,039,153 A * 6/1962 Dusing ..... 49/409
5,899,303 A * 5/1999 Allen ..... 187/333
6,098,341 A * 8/2000 Gebauer ..... 49/226

* cited by examiner

*Primary Examiner*—Jerry Redman
(74) *Attorney, Agent, or Firm*—Frost Brown Todd LLC

(57) ABSTRACT

A top-supported sliding door system or a vertically sliding door system achieves an enhanced air seal with a lateral keeper mechanism on either or both of the trailing and leading edges. On an outward lateral edge of a door panel, a keeper projects inwardly toward the door frame to engage a door frame camming surface such as a pin. The bracket may advantageously disengage under a force indicative of impact in order to minimize damage resulting therefrom. Application of the lateral keeper mechanism may further be used on vertically sliding doors and on multi-panel horizontal sliding doors. In addition, a rail may extend from the angled pin to engage the keeper throughout the full travel of the door panel.

11 Claims, 8 Drawing Sheets

SLIDING DOOR HAVING LATERAL KEEPER

CROSS REFERENCE TO RELATED APPLICATIONS

This application is a continuation in part of U.S. patent application Ser. No. 10/600,101, filed 20 Jun. 2003, now abandoned.

FIELD OF THE INVENTION

The present invention relates, in general, to sliding doors, and more particularly to doors suitable for cold storage rooms.

BACKGROUND OF THE INVENTION

Sliding doors typically move horizontally or vertically and parallel to the wall to which they are attached along a track system. In some applications, the door may move away from the wall on a track system once it has cleared the opening as in an overhead door or a vertical door that is tilted out from the wall. The door panel may be manually or automatically moved from its blocking position to an unblocking position. Some door openings may use multiple leaves to cover the opening. In horizontal applications, the leaves will move in opposite directions to clear the opening more quickly. In some instances, the amount of overhead track required to extend beyond the door opening is reduced by having the door panel vertically divided into a number of over-lapped, vertically-separated leaves that take up less horizontal space when moved to the unblocking position.

Cold storage lockers are often accessed through a door opening closed by a sliding door. The panels for this purpose are typically transparent vinyl sheets, minimally insulated flexible panels or foam filled rigid panels. The transparent vinyl sheets are selected to reduce the likelihood of damage to the door. In particular, such doors are used in an institutional (e.g., warehouse) setting wherein palletized cargo is moved in and out of a cold storage locker by forklift. Since this panel is transparent, it also allows forklift operators to see what is on the other side of the door before it is opened. Although providing damage resistance, these types of panels have a very low insulation value and are too flexible to provide an effective air seal between the environments on either side of the opening. Because of the properties of the material, the transparent vinyl sheets may develop a warp that prevents a good seal. Air pressure differentials will cause leakage due to the lack of a compressive seal between the door panels and the door frame. This will allow a significant amount of warm moist air to enter the cold storage locker and/or refrigerated air to be lost into an unrefrigerated space. Consequently, such door systems are less efficient to operate and can lead to ice accumulation in the cold storage locker.

Rigid door panels are often used, especially in the United States, in order to reduce the operating costs of a cold storage locker. The rigid panel provides a consistent surface to seal to the door frame. The thickness of the rigid door panel is selected to provide a specific amount of insulation. Since the panel is rigid, a constraint can be applied to the edges that are parallel to the direction of travel to seal the door against the gasket the full width of the panel perpendicular to the direction of travel. On a horizontal sliding door, the constraint is a floor-mounted device that presses against the door when it is closed. Typically, these devices are rollers that are bolted to the floor and, since they are rigidly mounted, they can be damaged or broken when the door is impacted and/or they cause damage to the panel during an impact. Elimination of the need for these items would reduce the amount of damage to a rigid panel during an impact. Rigid door panels do provide very good environmental separation; however, the panels become susceptible to differential air pressure defeating the air seal.

Vertical sliding doors, similar to the familiar residential garage door, are supported on both vertical sides. However, these doors can also suffer to a degree from a poor seal at the top lateral and/or bottom lateral edges, especially for a wide doorway. It would be desirable to also provide a way to urge these non-tracked edges into sealing contact with the door front.

Attempts have been made to provide a damage resistant door panel for a sliding door system that also provides sufficient insulation. Resilient door panels have been suggested which have sufficient thickness to insulate like a rigid door panel, but yield to a degree when impacted by a forklift. While the panel itself achieves a degree of insulation, the insulation capability of the overall door system suffers from poor sealing between panels and poor sealing between a panel and the door frame. The stiffness of each door panel is much less than that of a rigid panel so sealing across the full gasket width perpendicular to the direction of travel is very difficult.

Thus, approaches to seal the door known in rigid doors are not applicable. In U.S. Pat. No. 3,039,153, a shank is projected from the door frame that has a head that engages a medial slot in a plate attached to a sliding door panel. This binder assembly is disclosed as for maintaining a close seal for a fire door that slides close to the door frame. However, the binding assembly resides within the sealing area of the door frame and the door panel, forcing some spacing therebetween that must be overcome by other sealing components. Moreover, the binder assembly is incapable of overcoming any significant spacing of the door panel from the door frame. However, for a refrigerated door intended to translate quickly and to reduce damage due to impact, it is not desirable that the door panel necessarily translate closely to the door frame to allow engagement of such a binder assembly. Thus, such a planar binding assembly may not reliably engage upon door closure.

Consequently, a significant need exists for an improved sealing system for sliding doors that maintains a good air seal to the door frame. It would be desirable in some instances that the improved sealing system be releasable and easily resets. This will minimize damage of rigid panels and will improve the seal of flexible panels.

BRIEF SUMMARY OF THE INVENTION

The invention overcomes the above-noted and other deficiencies of the prior art by providing a sliding door system that achieves a good seal to a door frame with a lateral keeper on a lateral edge of each door panel that is pulled into a camming surface on the door frame. Thereby, warping of the door panel or an air pressure differential is overcome that may prevent a good seal. Moreover, this lateral keeper advantageously improves both rigid door panels as well as resilient door panels.

In one aspect of the invention, a keeper mechanism includes a first engagement device that is on a trailing surface of a horizontally sliding door panel, one that is not supported by a door track, which thus may be spaced away from a trailing edge of a door frame. This first keeper projects toward the door frame within a recess of the door frame to engage a second keeper that projects toward the door panel within this recess from a sealing surface of the door frame. These keepers slidingly engage and cam against one another as the door panel closes to urge the door panel against the sealing surface of the door frame. Moreover, insofar as these first and second keepers interact within a recess accessed at a trailing edge of the door frame and door panel, this camming action may overcome a significant amount of spacing therebetween and avoid contact with the door panel itself during opening and closing. Thereby, the door panel resists material warping or air pressure differentials that would otherwise impair a good sealing contact.

These and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION OF THE INVENTION

A sliding door system achieves a good seal to a door frame with a lateral keeper on a trailing edge of a door panel that is pulled into a camming surface on the door frame for bi-parting doors. For single door panels, a camming surface is also provided on the leading edge of the panel and a keeper is provided on the door frame. The system mechanically pulls the door into the gasket overcoming leaks in the seal that can be created by warping of the door panel or an air pressure differential and advantageously improves the seal of both rigid door panels and resilient door panels.

The term "lateral" used herein refers to a door panel edge, in either a horizontally or vertically sliding door system, that is traverse to the direction of open and closing. A leading edge is a lateral edge that is foremost during closing and a trailing edge is rearmost during closing.

Figure 1:
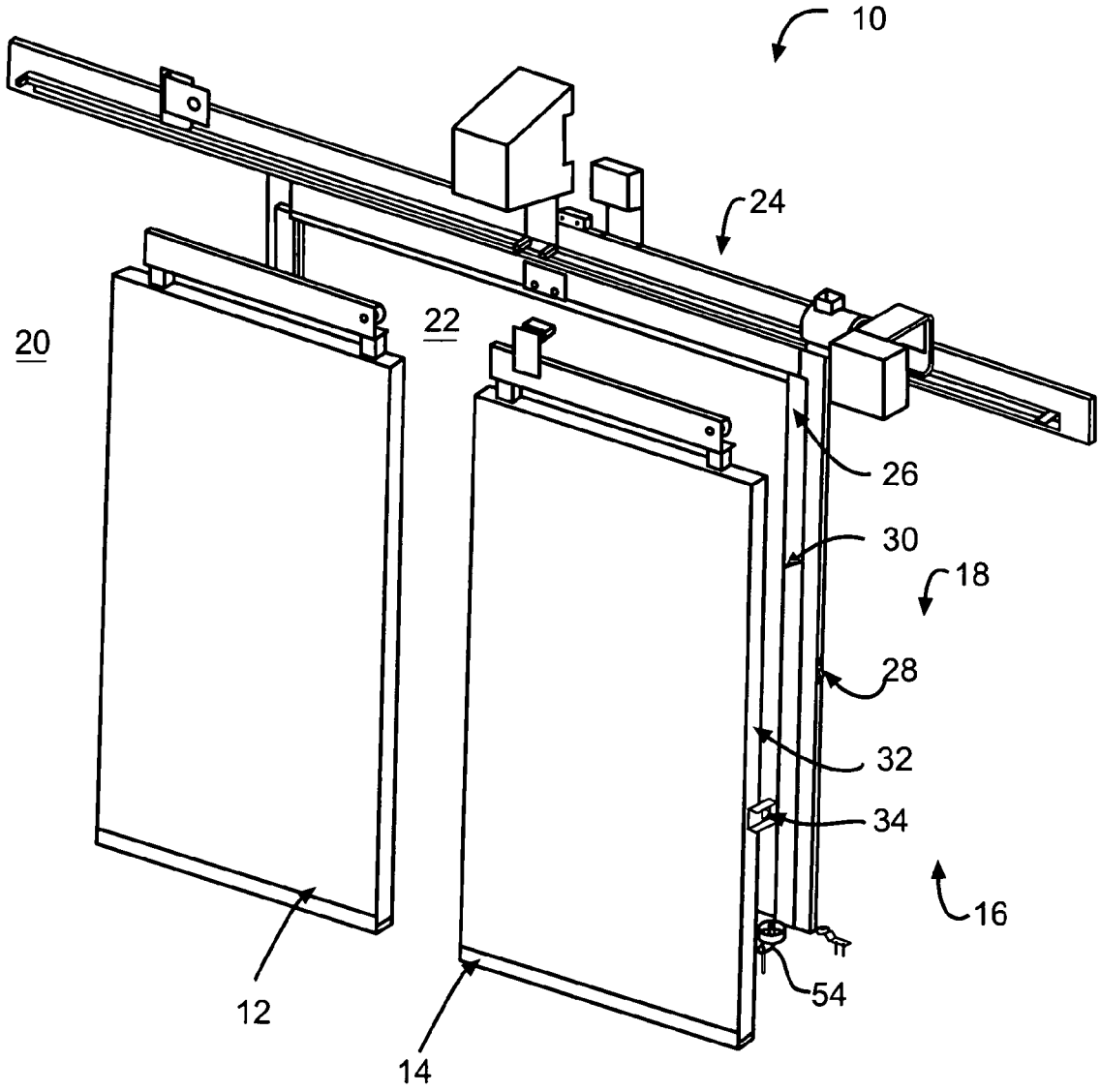
FIG. 1 is front exploded perspective view of a door system for an institutional cold storage locker.

Turning to the Drawings wherein like numbers denote like components throughout the several views, in FIG. 1, a closure system, depicted as a bi-parting horizontal sliding door system 10, advantageously includes door panels 12, 14 that are affirmatively sealed to a door frame 16 by a lateral keeper mechanism 18 to effectively separate a warm space 20 from a cold space 22 (e.g., a cold storage locker). As shown particularly in FIG. 1, the door panels 12, 14 are supported by and power actuated by an overhead carriage 24, as is generally understood by those skilled in the art.

Figure 2:
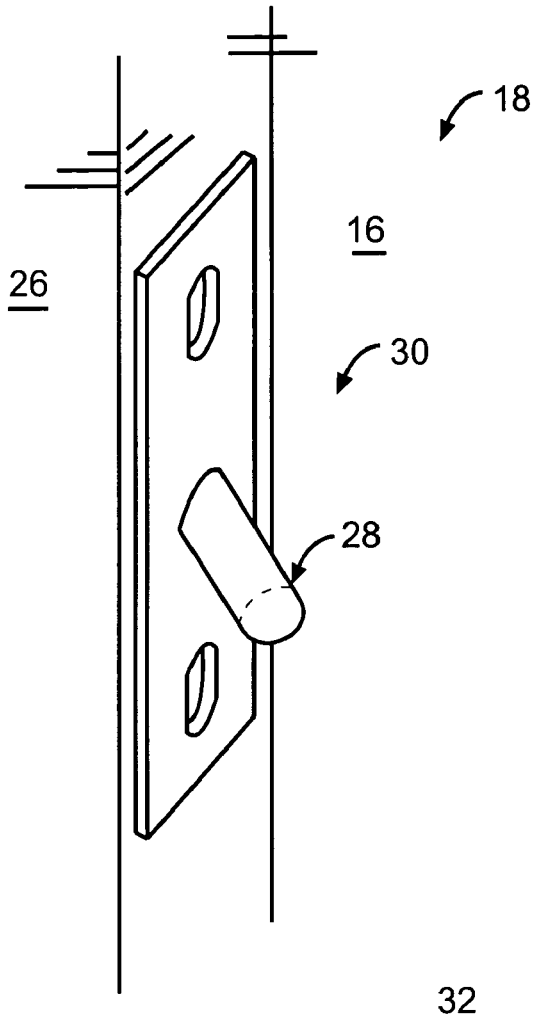
FIG. 2 is a top front perspective view of a door frame pin of the door system of FIG. 1.

Recessed back from a sealing surface 26 of the door frame 16, a camming surface, depicted as a keeper pin 28, is mounted laterally outward from a vertical portion 30 of the sealing surface 26. The keeper pin 28 is shown in greater detail in FIG. 2.

Figure 3:
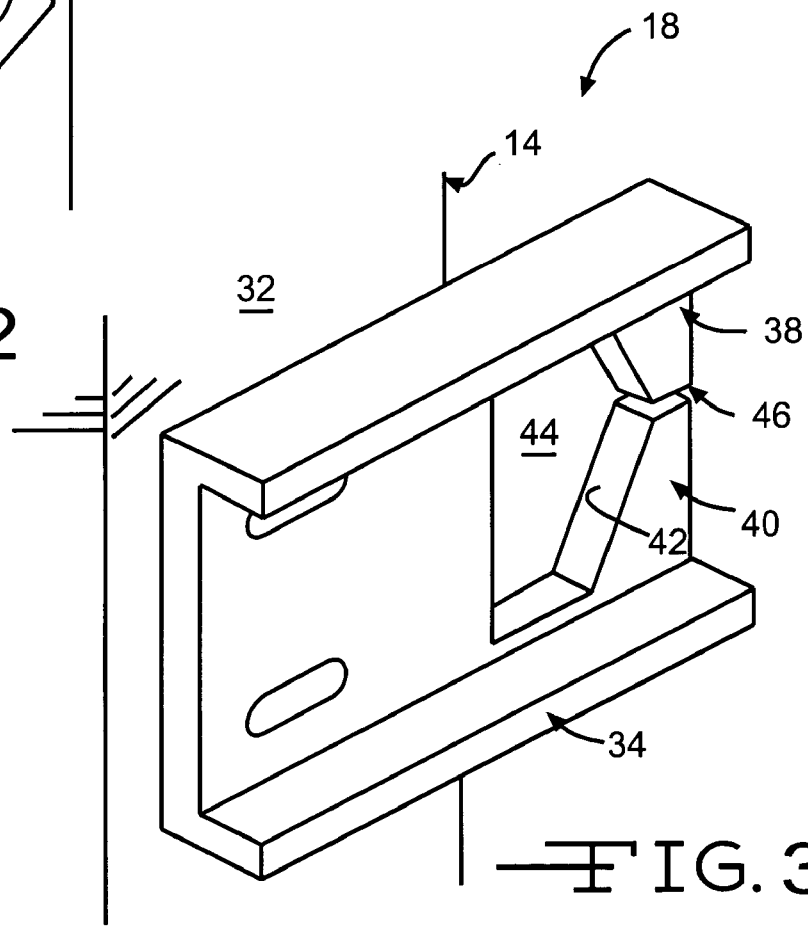
FIG. 3 is a front perspective view of a door panel releasable lateral keeper of the door system of FIG. 1.
Figure 4:
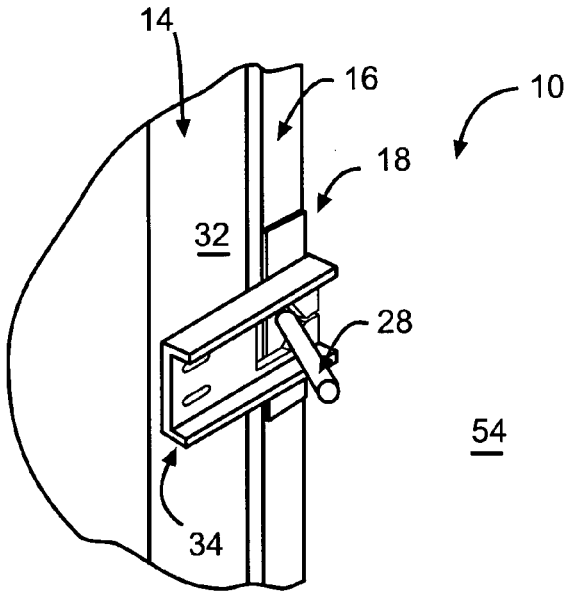
FIG. 4 is a front perspective view of the releasable lateral keeper engaging the door frame pin of the door system of FIG. 1.

Returning to FIG. 1, a vertical lateral edge 32 of the door panel 14 is shown as having a corresponding engagement device, depicted as a keeper 34, shown in greater detail in FIG. 3. The keeper 34 forms a female catch surface that projects toward the door frame 16 to capture the keeper pin 28 as the door panel 14 nears a closed position, thereby urging the door panel 14 into sealing contact with the door frame 16, as depicted in FIG. 4.

It will be appreciated that, alternatively, a camming surface may be incorporated into a door panel with a keeper affixed to a door frame. Furthermore, although the keeper pin 28 is recessed by having the sealing surface 26 spaced outward from the door frame 16, alternatively a keeper pin may be recessed into a channel (not shown) sized to receive a projecting portion of the keeper of the door panel so that the keeper of the door does not abrade the wall during opening and closing.

Figure 4A:
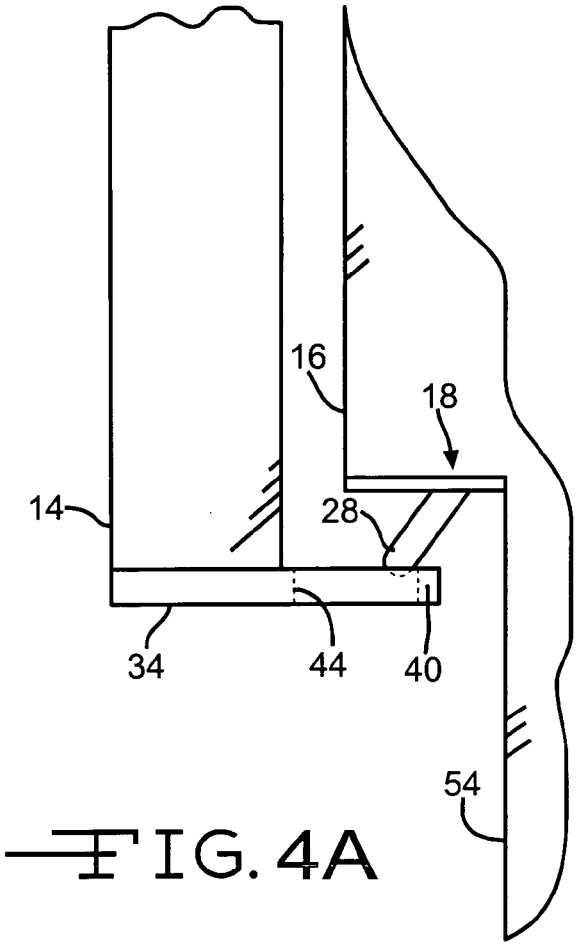
FIGS. 4A–4B are top views of the releasable lateral keeper, which has been installed for trailing edge use, engaging and then fully engaged to the door frame pin of the door system of FIG. 1.
Figure 4B:
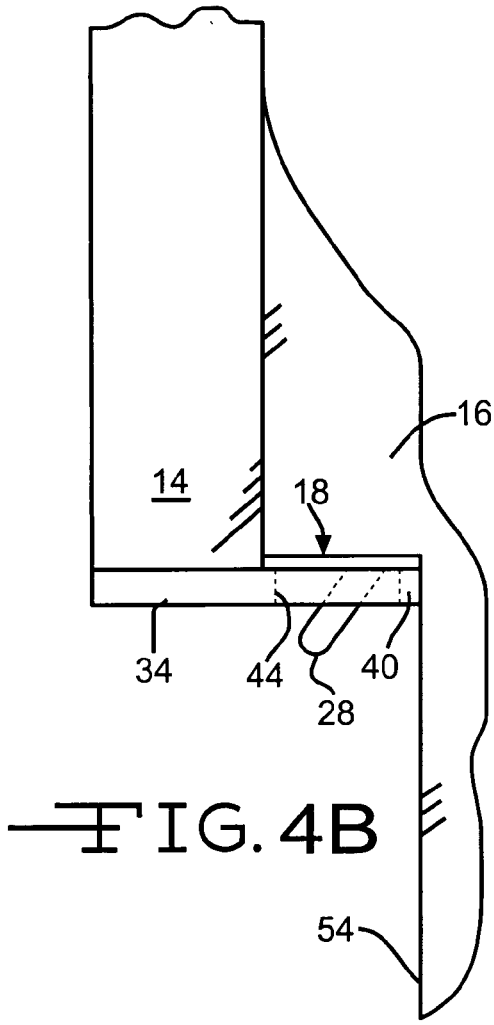
Figure 4C:
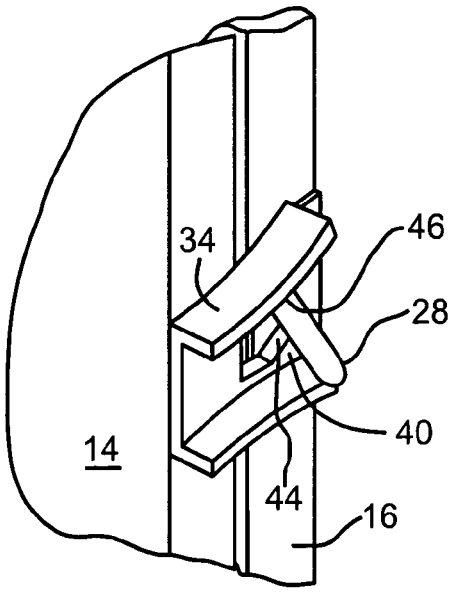
FIG. 4C is a top front perspective view of the door panel releasable lateral keeper of FIG. 4 deforming due to door impact.

With particular reference to FIG. 3, the keeper 34 is shown to advantageously include a deformable or resilient characteristic that is responsive to an abnormal load from an impact. Specifically, an upper finger 38 meets a lower finger 40 to form an engaging surface 42 for camming against the keeper pin 28. An aperture 44 formed therebetween is sized to receive the keeper pin 28 should the door panel 14 be initially spaced away from the door frame 16, as shown in FIGS. 4A–4B. The aperture 44 advantageously converges toward a split 46 between the upper and lower fingers 38, 40 to direct an impact force thereto, as shown in FIG. 4C.

Figure 4D:
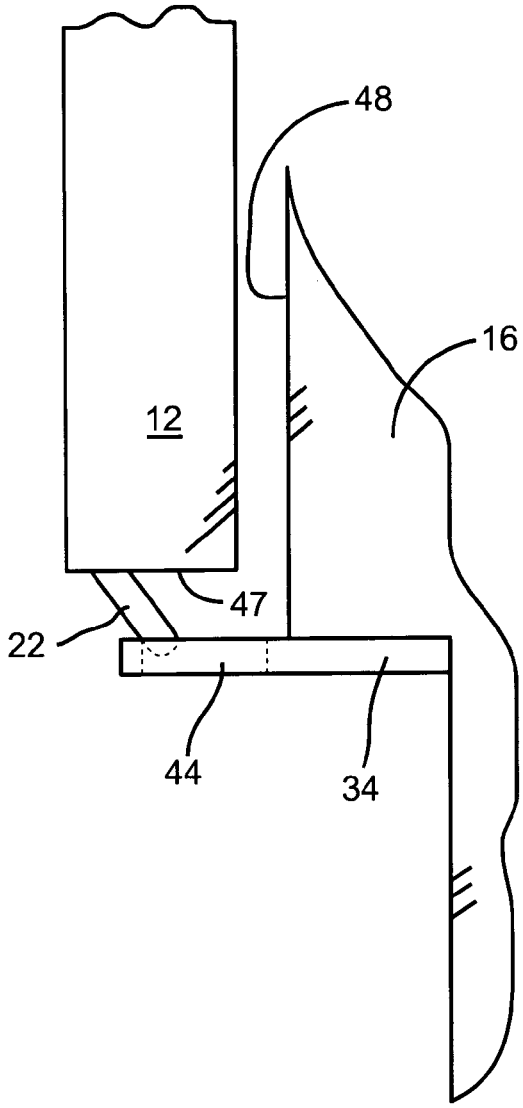
FIGS. 4D–4E are top views of the releasable lateral keeper, which has been installed for a leading edge use, engaging and then fully engaged to the door frame pin of the door system of FIG. 1.
Figure 4E:
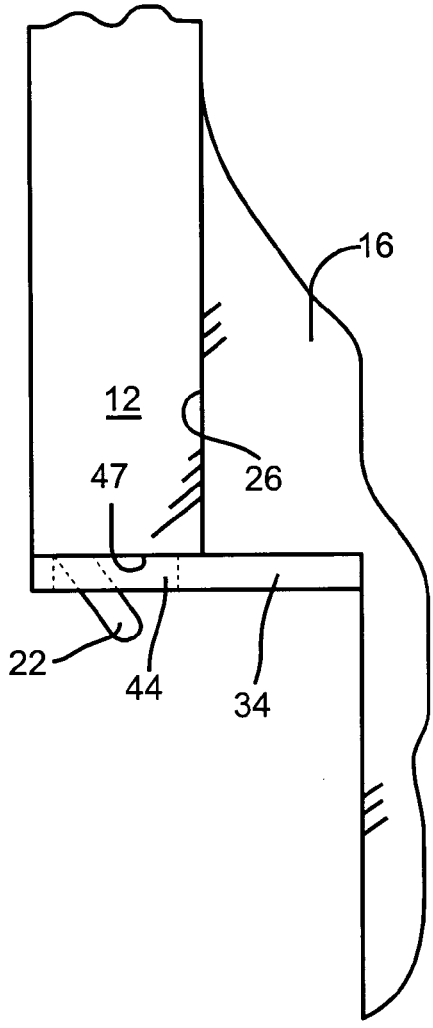

In FIGS. 4D–4E, a leading edge 17 of the door panel 12 is depicted first approaching a leading vertical edge 48 of the door frame 16. The keeper 34 in this installation is thus attached to the door frame 16 with its aperture 44 projecting outwardly into the plane traversed by the door panel 12. The keeper pin 22 is attached to the leading edge 47 of the door panel. The keeper pin 22 projects toward the door frame 16 but advantageously does not project inward of the door panel 12 and thus avoids contact to the door frame 16 during opening and closing. In FIG. 4E, the keeper pin 22 cams within the aperture 44 of the keeper (female catch) 34 drawing the leading edge 47 of the door panel 12 into sealing contact with the sealing surface 26 of the door frame 16. It should be appreciated that deformable or frangible elements may be incorporated into one or more of the components of the keeper pin 22 and/or keeper 34 to allow for disengagement of the door panel 12 during accidental impact.

Figure 5:
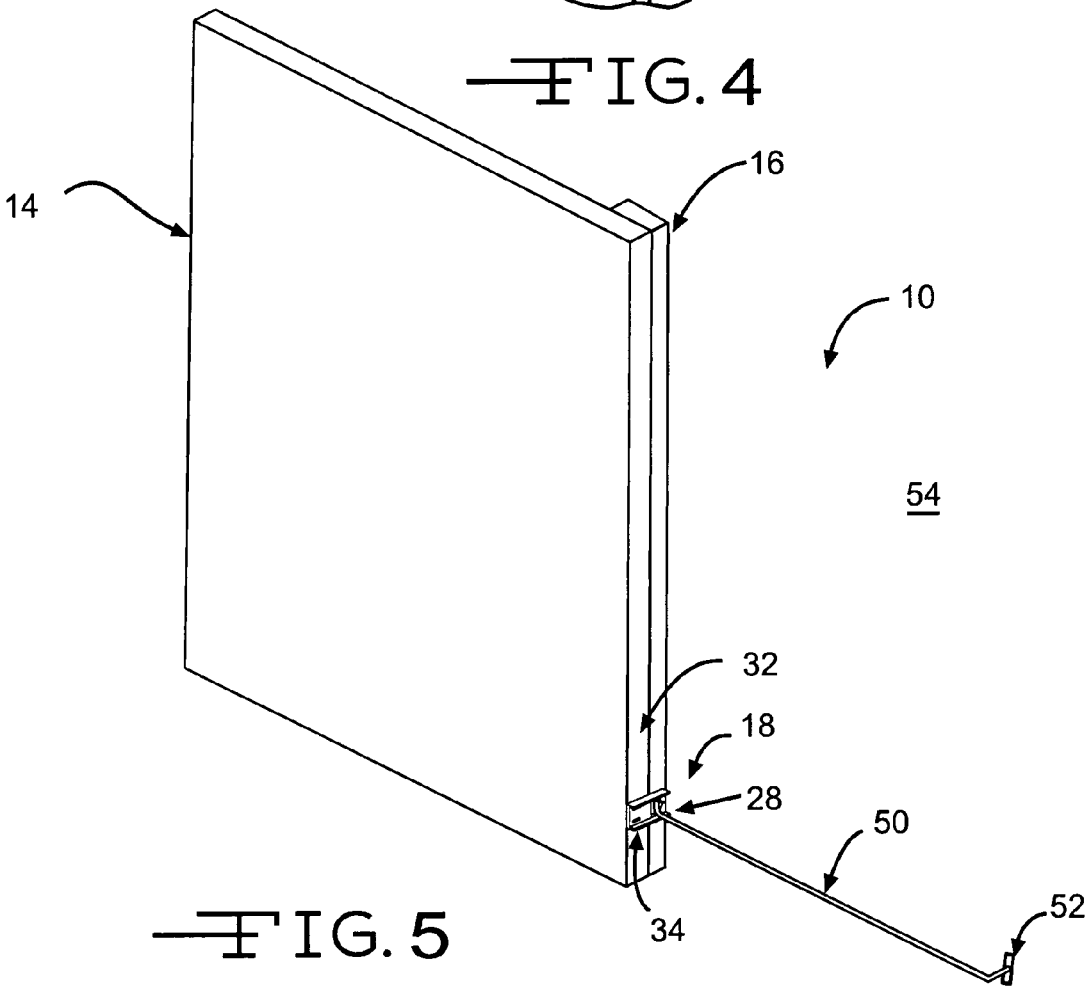
FIG. 5 is front perspective view of a sliding door system for an institutional cold storage locker incorporating a full-travel lateral keeper.
Figure 6:
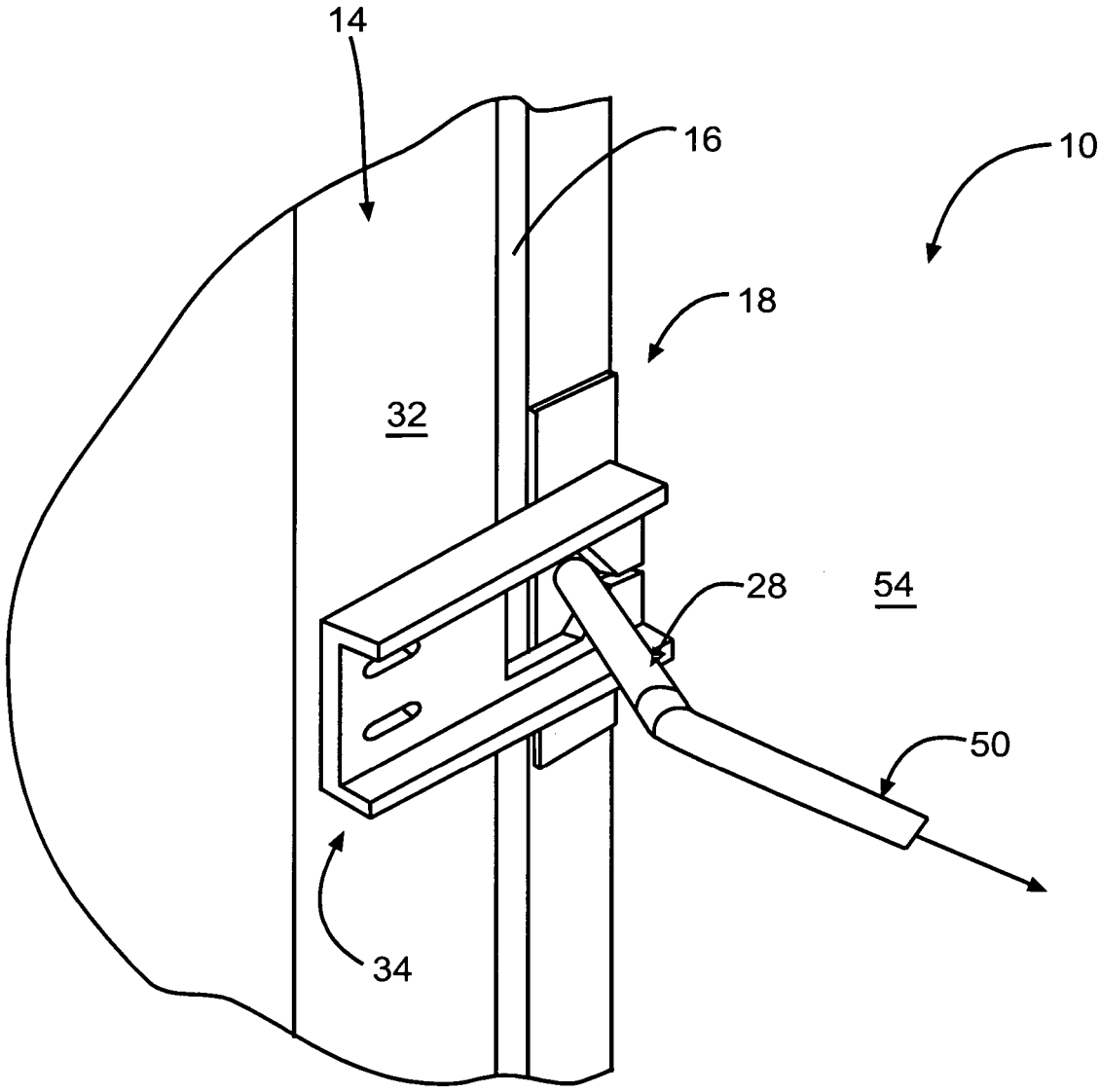
FIG. 6 a detail view of a door panel coupling to the full-travel lateral keeper.

With regard to FIGS. 5–6, an additional feature is depicted by including an extension member, depicted as a rail 50, which is connected to the keeper pin 28 and positioned parallel to the wall and floor to remain engaged to the keeper 34 during the full travel of the door panel 14. An outer end of the rail 50 transitions to an outer bracket 52 attached to a wall 54 or to the floor. Typically, the outer bracket 52 is further away from the doorway than the keeper 34 traverses during opening and closing. Therefore, other devices such as a stay roller (shown at 54 in FIG. 1) are not necessary to ensure proper operation. A device is usually required on the floor because air pressure on the back of the door can push it far enough away from the wall that sealing is poor. However, the additional outward resistance offered by such a device as a stay roller may tend to allow additional damage to occur to the door when impacted. Alternatively, the door panel 14 may suffer from additional wear due to continued contact with the stay roller.

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art.

For example, in the illustrative embodiment, the keeper 34 is advantageously formed from a polymer in order to provide lubricity and the desired resiliency, and the keeper pin 28 is formed from metal for strength. However, either may be formed from a metal, a polymer, a composite material, etc.

Figure 7:
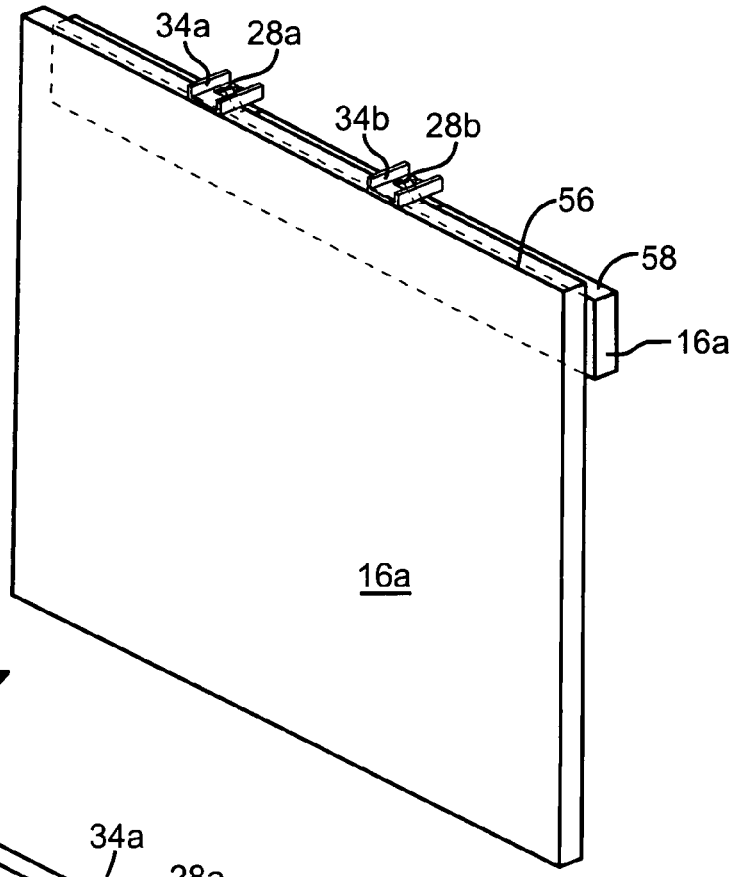
FIGS. 7–8 are top front perspective views of door panel releasable lateral keepers used on a vertically translating door panel.
Figure 8:
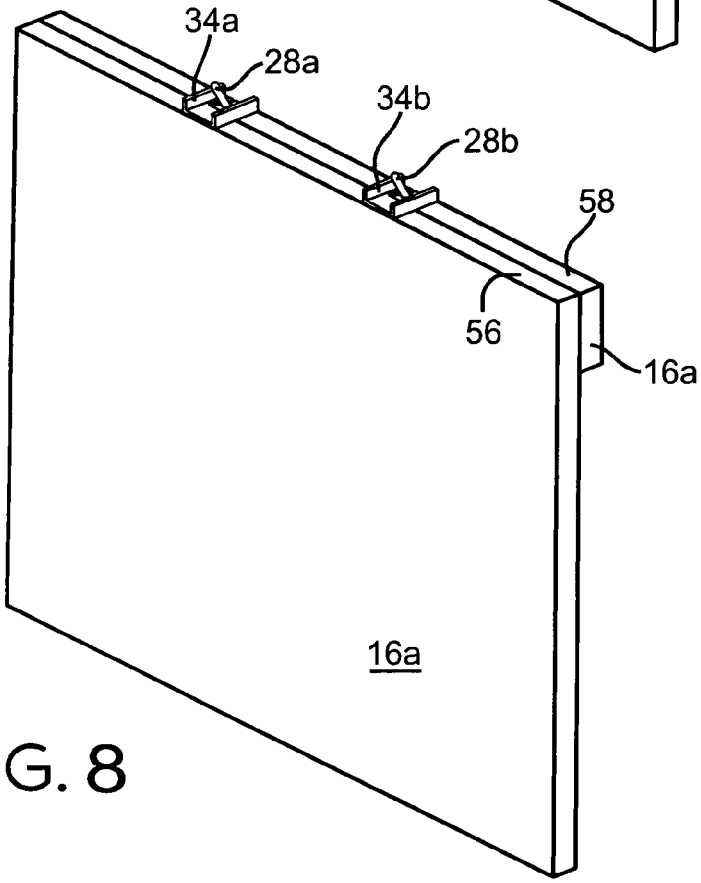
Figure 9:
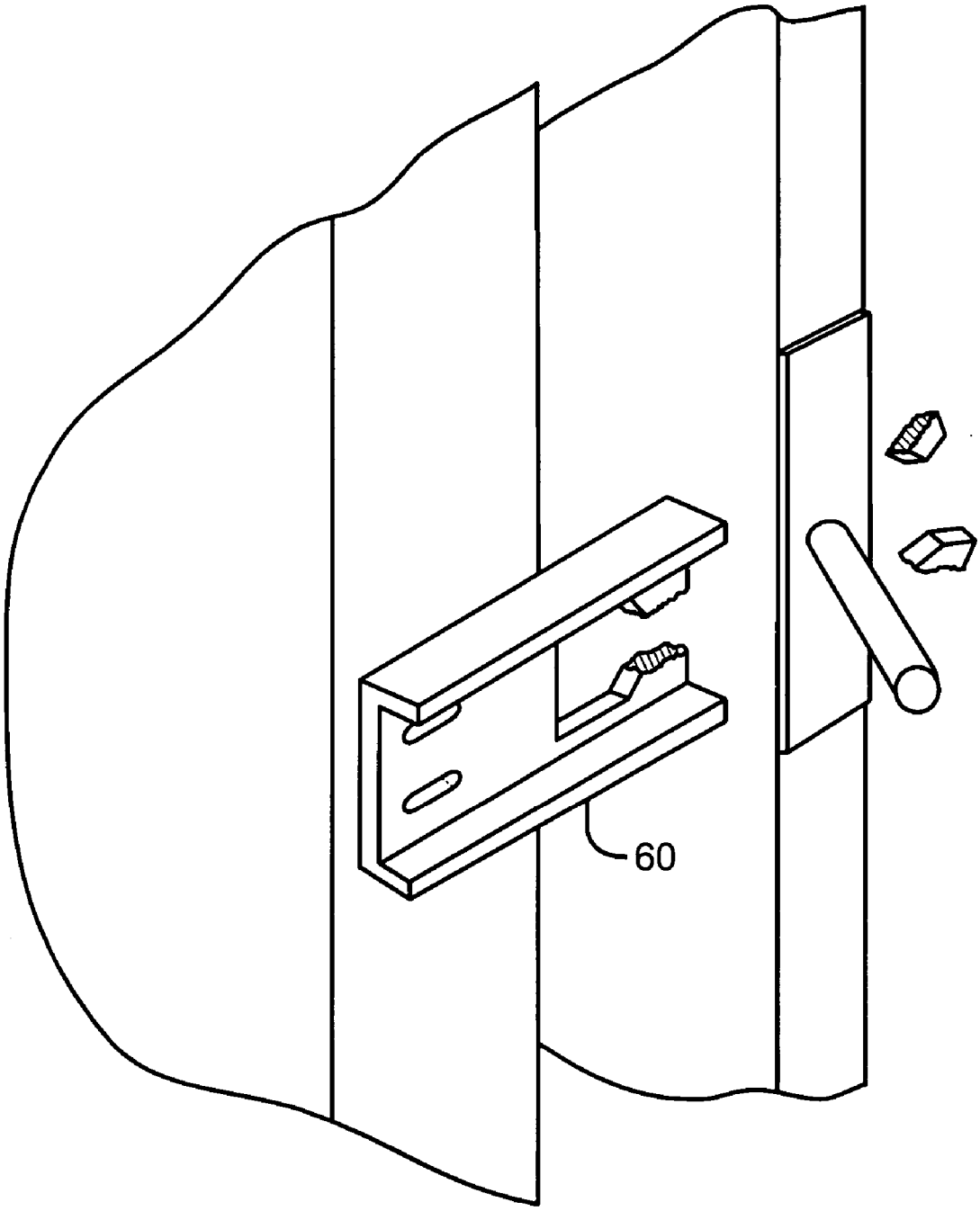
FIG. 9 is a perspective view of a frangible lateral keeper releasing the keeper pin due to door impact.

As another example, it will be appreciated that the capability for disengaging in response to an impact force may be omitted in applications such as a rigid door panel, such as shown in FIGS. 7–8 for a rigid, vertically translating door panel 169 having two keepers 349, 346 spaced on a top trailing edge 56 to capture respective keeper pins 28*a*, 28*b* on a top edge 58 of door frame 16*a*. Moreover, instead of a resiliently engaging device with a preformed split 46, a frangible keeper 60 (FIG. 9) may be used consistent with aspects of the invention whereby the keeper is replaced after an impact. Alternatively, the keeper pin 28 may be selected to resiliently yield or to fracture under impact loads.

What is claimed is:

1. A door system, comprising:

a door frame defining an entrance and having a resilient sealing surface and having a recess approaching a trailing edge of the sealing surface;

a door track mounted across a top portion of the door frame;

a door panel supported by the door track for movement between an open position and a closed position with the sealing surface of the door frame; and a keeper frangible mechanism for drawing the door panel into sealing contact with the door surface frame, comprising:

a first engagement device on a trailing lateral surface of the door panel, projecting into the recess of the door frame, and a second engagement device projecting toward the door panel within the recess of the door frame forming an acute angle with the door frame away from the entrance, the first and second engagement devices slidingly cam during closing of the door panel to urge the trailing lateral surface of the door panel toward the sealing surface of the door frame.

2. The door system of claim 1, wherein a selected one of the first and second engagement devices comprises a deformable device adapted to disengage from the other engagement device in response to an impact to the door panel.

3. The door system of claim 1, wherein the first engagement device comprises a female catch member and the second keeper device comprises a male camming surface.

4. The door system of claim 3, wherein the female catch member comprises a keeper and the male camming surface comprises an angled post.

5. The door system of claim 4, wherein the keeper includes a split engaging surface registered to the camming surface and having an upper member and lower member adapted to resiliently separate in response to an impact force.

6. A door system, comprising:

a door frame defining an entrance and having a sealing surface and having a recess approaching a trailing edge of the sealing surface;

a door track mounted across a top portion of the door frame;

a door panel supported by the door track for movement between an open position and a closed position with the sealing surface of the door frame; and a keeper mechanism for drawing the door panel into sealing contact with the door surface frame, comprising:

a first engagement device on a trailing lateral surface of the door panel, projecting into the recess of the door frame, a second engagement device projecting toward the door panel within the recess of the door frame, the first and second engagement devices adapted to slidingly cam during closing of the door panel to urge the trailing lateral surface of the door panel toward the sealing surface of the door frame, wherein the first engagement device comprises a female catch member and the second keeper device comprises a male camming surface, wherein the female catch member comprises a keeper and the male camming surface comprises an angled post, wherein the keeper includes a split engaging surface registered to the camming surface and having an upper member and lower member adapted to resiliently separate in response to an impact force, and wherein the camming surface further comprises a rail extending outward aligned with travel of the keeper during opening and closing of the door panel.

7. The door system of claim 6, further comprising a second keeper mechanism spaced apart along the trailing edge of the door frame and door panel from the first keeper mechanism.

8. The door system of claim 6, further comprising:

an opposing door panel supported by the door track for opposing movement to the door panel between an open position and a closed position with the sealing surface of the door frame, the two door panels sized to together close the entrance; and another set of first and second keeper devices configured to urge a trailing edge of the opposing door panel toward the sealing surface of the door frame.

9. A door system, comprising:

a door frame defining an entrance and having a sealing surface and having a recess approaching a trailing edge of the sealing surface;

a door track mounted across a top portion of the door frame;

a door panel supported by the door track for movement between an open position and a closed position with the sealing surface of the door frame; and a keeper mechanism for drawing a leading edge of the door panel into sealing contact with the door surface frame, comprising:

a first engagement device on a leading lateral surface of the door frame, projecting into the plane of travel of the door panel; and a second engagement device mounted on a leading edge of the door panel and projecting toward the first engagement device, the first and second engagement devices adapted to slidingly cam during closing of the door panel to urge the leading lateral surface of the door panel toward the sealing surface of the door frame;

wherein the first engagement device comprises a female catch member and the second keeper device comprises a male camming surface;

wherein the female catch member comprises a keeper and the male camming surface comprises an angled post; and wherein the female catch member includes an inner engaging surface registered to the camming surface formed of a frangible material operatively configured to break in response to an impact force, releasing the angled post and door panel.

10. The door system of claim 9, further comprising a second keeper mechanism spaced apart along the leading edge of the door frame and door panel from the first keeper mechanism.

11. A door system, comprising:

a door frame defining an entrance and having a sealing surface and having a recess approaching a trailing edge of the sealing surface;

a door track mounted across a top portion of the door frame;

a door panel supported by the door track for movement between an open position and a closed position with the sealing surface of the door frame; and a keeper mechanism for drawing the door panel into sealing contact with the door surface frame, comprising:

a first engagement device on a trailing lateral surface of the door panel, projecting into the recess of the door frame, a second engagement device projecting toward the door panel within the recess of the door frame, the first and second engagement devices adapted to slidingly cam during closing of the door panel to urge the trailing lateral surface of the door panel toward the sealing surface of the door frame, wherein the first engagement device comprises a female catch member and the second keeper device comprises a male camming surface;

wherein the female catch member comprises a keeper and the male camming surface comprises an angled post; and wherein the female catch member includes an inner engaging surface registered to the camming surface formed of a frangible material operatively configured to break in response to an impact force, releasing the angled post and door panel.

* * * * *

UNITED STATES PATENT AND TRADEMARK OFFICE

CERTIFICATE OF CORRECTION

PATENT NO. : 7,155,861 B2
APPLICATION NO. : 10/912860
DATED : January 2, 2007
INVENTOR(S) : Curtis L. Berry and William B. Nichols It is certified that error appears in the above-identified patent and that said Letters Patent is hereby corrected as shown below:

Claim 1
Col. 5, line 55, "a keeper frangible mechanism" should be -- a frangible keeper mechanism--.

Signed and Sealed this

Twentieth Day of March, 2007

JON W. DUDAS
*Director of the United States Patent and Trademark Office*